US005456193A

United States Patent [19]

Boot

[11] Patent Number: 5,456,193

[45] Date of Patent: Oct. 10, 1995

[54] APPARATUS FOR AUTOMATICALLY MANUFACTURING PANEL ASSEMBLIES

[75] Inventor: Jeffrey T. Boot, Sudbury, Mass.

[73] Assignee: Design Technology Corporation, Billerica, Mass.

[21] Appl. No.: 184,004

[22] Filed: Jan. 19, 1994

[51] Int. Cl.[6] ..... D05B 3/00; D05B 27/00; D05B 33/00; D05B 37/04

[52] U.S. Cl. ..... 112/470.13; 112/2; 112/304; 112/308; 112/307; 112/130; 112/282; 112/470.36; 112/475.09

[58] Field of Search ..... 112/2, 10, 303, 112/304, 121.14, 121.15, 121.29, 307, 121.11, 121.12, 130, 152, 153, 262.2, 262.1, 282, 308; 242/420.6, 594, 594.5

[56] References Cited

U.S. PATENT DOCUMENTS 3,082,717 3/1963 Forte ..... 112/10
3,871,312 3/1975 Rockerath et al. ..... 112/304
4,214,541 7/1980 Zeigler, Jr. et al. ..... 112/121.29
4,483,262 11/1984 Keeton ..... 112/121.29
4,856,439 8/1989 O'Neal et al. ..... 112/10

*Primary Examiner*—C. D. Crowder
*Assistant Examiner*—Paul C. Lewis
*Attorney, Agent, or Firm*—Rhodes, Coats & Bennett

[57] ABSTRACT

An apparatus for manufacturing front panels for men's underwear from continuous bands of web material. The apparatus includes a pay-out mechanism for paying out the continuous bands of web material. A web conveyance system conveys first and second continuous bands of web material along an assembly line to a plurality of stations disposed along the assembly line for fabricating discrete front panel assemblies from the continuous bands of web material. An automatic loader receives the front panel assembly from the web conveyance system and transfers the front panel assemblies to a receiving apparatus where it is bound into bundles for subsequent use.

41 Claims, 9 Drawing Sheets

APPARATUS FOR AUTOMATICALLY MANUFACTURING PANEL ASSEMBLIES

BACKGROUND OF THE INVENTION (1) Field of the Invention

The present invention relates generally to automated manufacturing systems and, more particularly, to an apparatus for manufacturing front panel assemblies for a men's brief or the like from continuous bands of a web material.

(2) Description of the Prior Art

The manufacture of textile clothing articles such as briefs, tee-shirts and outer garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

Thus, there remains a need for an apparatus for manufacturing front panel assemblies for a men's brief or the like which can be carried out completely automatically without the need for a skilled operator.

SUMMARY OF THE INVENTION

The present invention is directed to an apparatus for manufacturing front panels for men's underwear from continuous bands of web material. The apparatus includes a pay-out mechanism for paying out the continuous bands of web material. A web conveyance system conveys first and second continuous bands of web material along an assembly line to a plurality of stations disposed along the assembly line for fabricating discrete front panel assemblies from the continuous bands of web material.

The stations include first and second die cutters disposed at a first station along the web conveyance system for making arcuate fly cuts in respective webs at a predetermined distance apart from one another. First and second binding apparatuses are disposed at a second station along the web conveyance system downstream from the first station for binding the edges of the arcuate fly cuts. A sewing apparatus disposed at a third station along the web conveyance system downstream of the second station for joining the continuous webs along the outer edges thereof to form a laminate. A trimming apparatus is disposed at a fourth station along the web conveyance system downstream of the third station for trimming the opposed edges of the laminated web material. Finally, cutting means cut the laminated web material into predetermined lengths to form discrete front panel assemblies from the laminated web material.

An automatic loader receives the front panel assembly from the web conveyance system and transfers the front panel assemblies to a receiving apparatus where it is bound into bundles for subsequent use.

Accordingly, one aspect of the present invention is to provide an apparatus for manufacturing front panels for men's underwear from continuous bands of web material.

The apparatus includes: (a) a pay-out mechanism for paying out the continuous bands of web material; (b) a web conveyance system for conveying first and second continuous bands of web material along an assembly line; and (c) means disposed along the assembly line for fabricating discrete front panel assemblies from the continuous bands of web material.

Another aspect of the present invention is to provide an apparatus for manufacturing front panels for men's underwear from first and second continuous bands of web material conveyed by a web conveyance system from a supply source to a discharge station. The apparatus includes: (a) first and second die cutters disposed at a first station along the web conveyance system for making arcuate fly cuts in respective webs at a predetermined distance apart from one another; (b) first and second binding apparatuses disposed at a second station along the web conveyance system downstream from the first station for binding the edges of the arcuate fly cuts; (c) a sewing apparatus disposed at a third station along the web conveyance system downstream of the second station for joining the continuous webs along the outer edges thereof to form a laminate; (d) a trimming apparatus disposed at a fourth station along the web conveyance system downstream of the third station for trimming the opposed edges of the laminated web material; and (e) cutting means for cutting the laminated web material into predetermined lengths to form discrete front panel assemblies from the laminated web material.

Still another aspect of the present invention is to provide an apparatus for manufacturing front panels for men's underwear from continuous bands of web material. The apparatus includes: (a) a pay-out mechanism for paying out the continuous bands of web material; (b) a web conveyance system for conveying first and second continuous bands of web material along an assembly line; (c) means disposed along the assembly line for fabricating discrete front panel assemblies from the continuous bands of web material including: (i) first and second die cutters disposed at a first station along the web conveyance system for making arcuate fly cuts in respective webs at a predetermined distance apart from one another; (ii) first and second binding apparatuses disposed at a second station along the web conveyance system downstream from the first station for binding the edges of the arcuate fly cuts; (iii) a sewing apparatus disposed at a third station along the web conveyance system downstream of the second station for joining the continuous webs along the outer edges thereof to form a laminate; (iv) a trimming apparatus disposed at a fourth station along the web conveyance system downstream of the third station for trimming the opposed edges of the laminated web material; and (v) cutting means for cutting the laminated web material into predetermined lengths to form discrete front panel assemblies from the laminated web material; and (d) a loader for receiving the front panel assembly from the web conveyance system and transferring the front panel assemblies to a receiving apparatus.

These and other aspects of the present invention will become apparent to those skilled in the art after a reading of the following description of the preferred embodiment when considered with the drawings.

DESCRIPTION OF THE PREFERRED EMBODIMENTS

Figure 1:
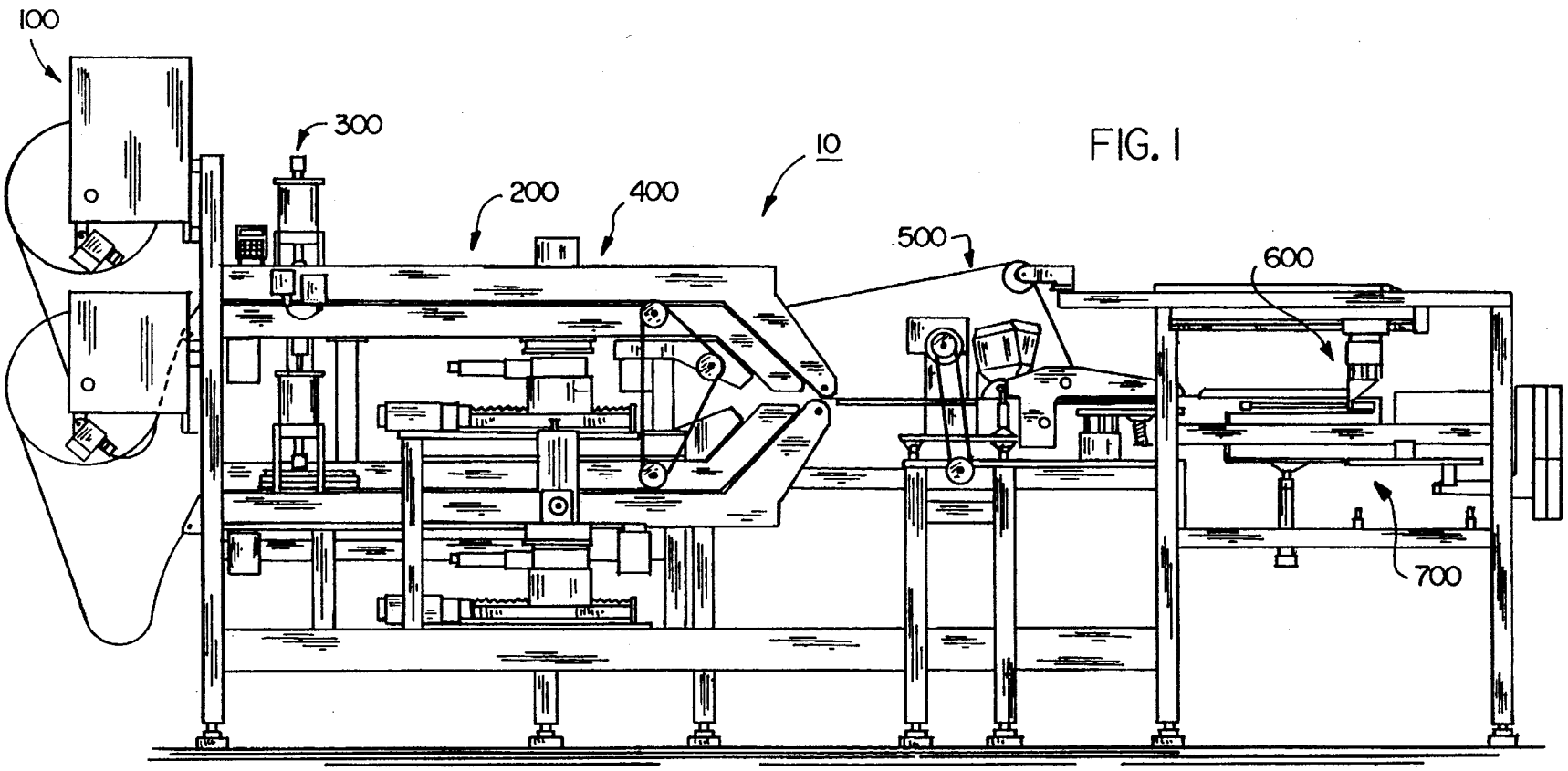
FIG. 1 is an elevation view of a preferred embodiment of a front panel loader constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a front panel loader 10 constructed according to the present invention is shown. The front panel loader 10 fabricates front panels for men's briefs from continuous bands of web material. The front panel loader 10 includes a pay-out station 100 for feeding continuous bands of web material from a roll or other supply source, a web conveyance system 200 for conveying the continuous bands of web material from the supply source to a discharge station, a die cutting station 300 for making arcuate cut-outs in respective edges of the web material, a binding station 400 for sewing a binding material to the edges of the arcuate cut-outs, and a finishing station 500 for joining the bands of web material in overlapping relationship, trimming the opposed edges of the laminated web material, and cutting the laminated web material into predetermined lengths to form discrete front panel assemblies.

The front panel loader 10 may also include a loading mechanism 600 for receiving the finished front panel assemblies from the discharge end of the conveyance system 200 and loading the front panel assemblies into a receiving apparatus. The receiving apparatus may include a stacking bin where the front panel assemblies are stacked one on top of the other, or a holding fixture which receives the front panel assembly.

Figure 2:
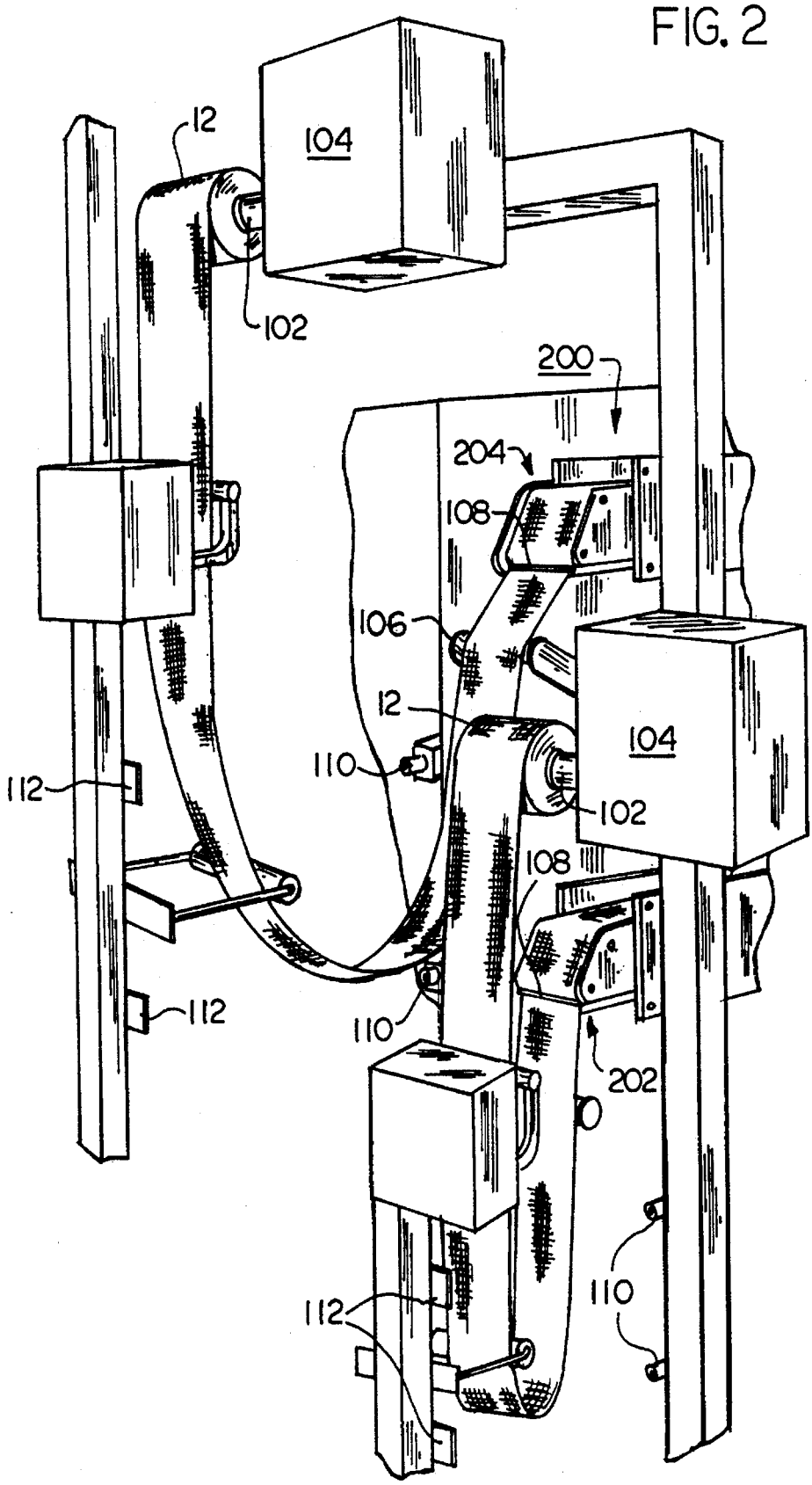
FIG. 2 is an isometric view illustrating the payout station.
Figure 3:
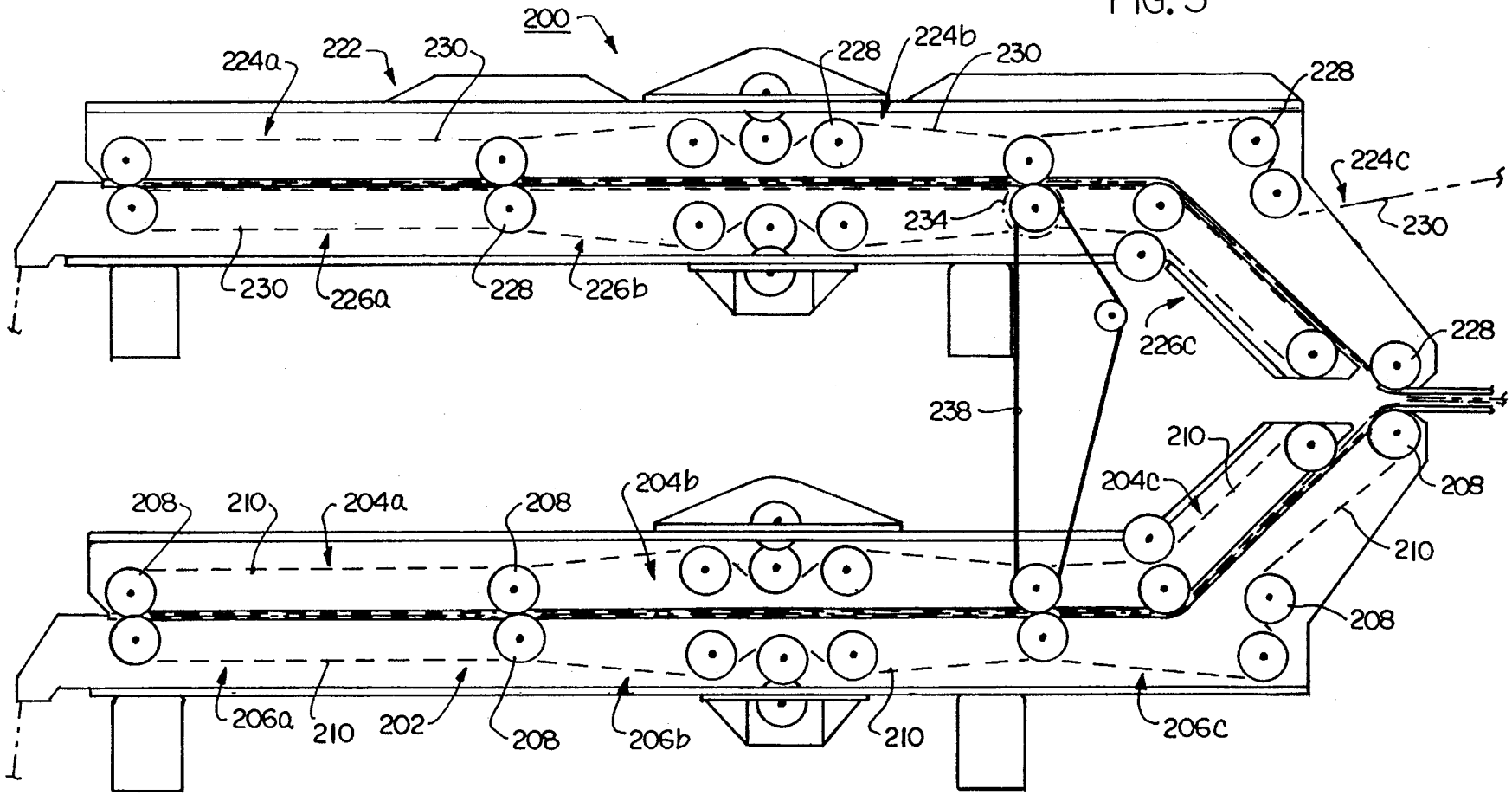
FIG. 3 is a schematic elevation view showing the layout of the web conveyance system.

Referring now to the pay-out station 100 shown in FIG. 2, two rolls 12 of web material are mounted on spindles 102. The spindles 102 are positively driven by respective spindle drives 104. The spindle drives 104 rotate the spindle 102 to payout the web material from roll stock. The web material is guided towards the conveyance system 200 by passive edge guides 106 which engage respective edges of the web material as it is fed into the conveyance system 200. The edge guides 106 ensure that the web material is properly aligned with the conveyance system 200 as it is fed into the conveyance system 200. The web material passes through a series of guide bars 108 before entering the conveyance means 200. The guide bars 108 prevent the web material from curling or buckling as it is fed into the conveyance means 200.

As seen in FIG. 1, the web material forms a loop 14 prior to entering the web conveyance system 200. No tensioning mechanisms or dancers are used since it is desired to minimize the tension on the web material. The lowermost point of the loop 14 is monitored by sensors 110 which are mounted to the frame on one side of the web material. Reflectors 112 are mounted to the frame on the opposite side of the web material. When the lowermost point of the loop is raised to the uppermost sensor 110, the speed of the spindle drive 104 is increased momentarily to a speed slightly faster than the conveyor. Conversely, when the lowermost point of the loop reaches the bottom sensor 110, the spindle drive 104 is momentarily stopped until the excess of material is taken up by the conveyance system 200.

Also the supply rolls 12 for the web material are offset from the edge guides 106. By offsetting the supply roll 12 in this manner, the web material is urged into contact with the edge guides 106 and will be properly aligned as the web material goes into the conveyance system 200.

The web material is inspected by a visual imaging system which includes a pair of cameras 114. If a defect is found, an in jet 116 is actuated to mark the top web. Subsequently in the process, the panel assemblies containing the defect are removed as will be hereinafter described.

The web conveyance system 200 advances the web material from the pay-out station through each succeeding station up to the loading station 600. Additionally, the conveyance system accurately positions the web at each station. The web conveyance system 200 comprises two vertically spaced belt conveyors 202 and 222 for transporting respective bands of the web material. The conveyors 202 and 222 extend generally parallel to one another in vertically-spaced relationship through the die cutting station 300 and binding station 400. The conveyors 202 and 222 converge with one another following the binding station 400 to overlay the uppermost band of web material on the lowermost band. The bottom conveyor 202 terminates at this point and the top conveyor 222 continues to advance the web material against a dead plate through the finishing station 500 and up to the loading station 600.

The bottom conveyor 202 comprises two flexible drive assemblies 204 and 206. The drive assembly 204 comprises three segments 204*a*, 204*b*, and 204*c*. Similarly, the lower drive assembly 206 comprises segments 206*a*, 206*b*, and 206*c*. Each segment 204*a,b, c*, and 206*a,b,c* comprises a series of pulleys 208 and an endless belt 210 which is entrained around the pulleys 208. The central segments 204*b* and 206*b* share a pulley 208 with the adjacent end segments 204*a,c* and 206*a,c* so that the individual segments are all driven at the same speed.

The top conveyor 222 is similar to the bottom conveyor 202. The top conveyor 222 includes two flexible drive assemblies 224 and 226. Each drive assemblies each include three segments 224*a,b,c*, and 226*a,b,c*. Each segment includes pulleys 228 and an endless belt 230 which is entrained around the pulleys 228.

The drive assemblies 204, 206, 224, and 226 are driven by a single drive motor 234. The drive motor directly drives the top conveyor 222. A drive belt 238 interconnects the upper conveyor 222 with the bottom conveyor 202 so that they are driven at the same speed.

The drive motor 234 is actuated by a programmable logic controller which controls the operation of the entire front panel loader 10. The web material is conveyed and then stopped while operations are performed on the web material at the die cutting station 300, binding station 400, and finishing station 500. When these operations are completed, the web conveying system 200 is actuated to index the web material and then the operations are repeated.

DIE CUTTING STATION

Figure 4:
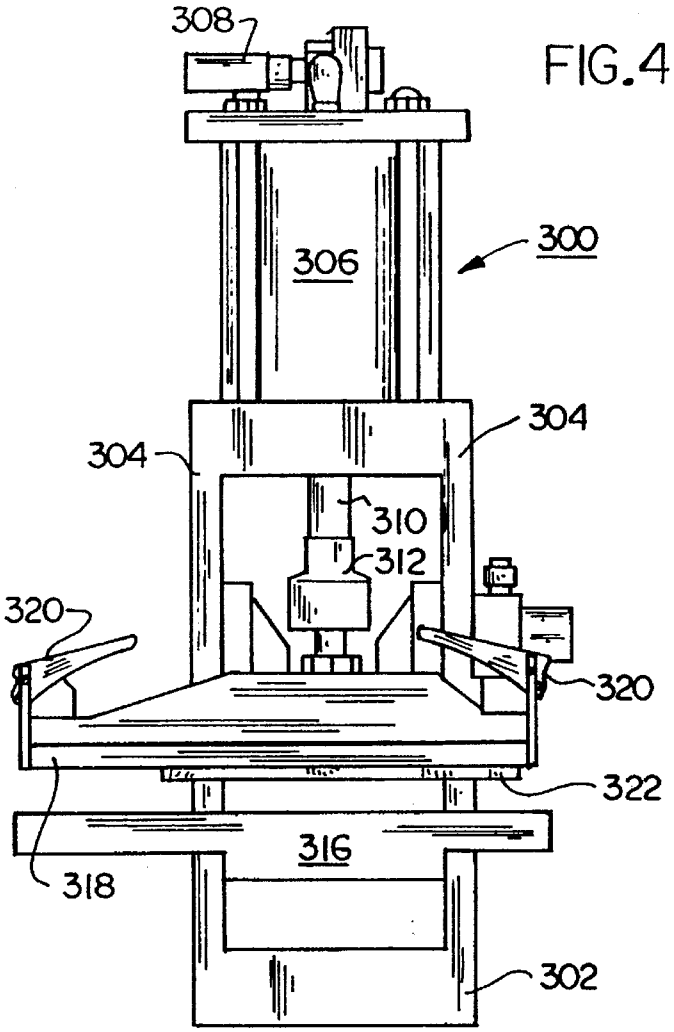
FIG. 4 is an elevation view of the die cutting station.
Figure 5:
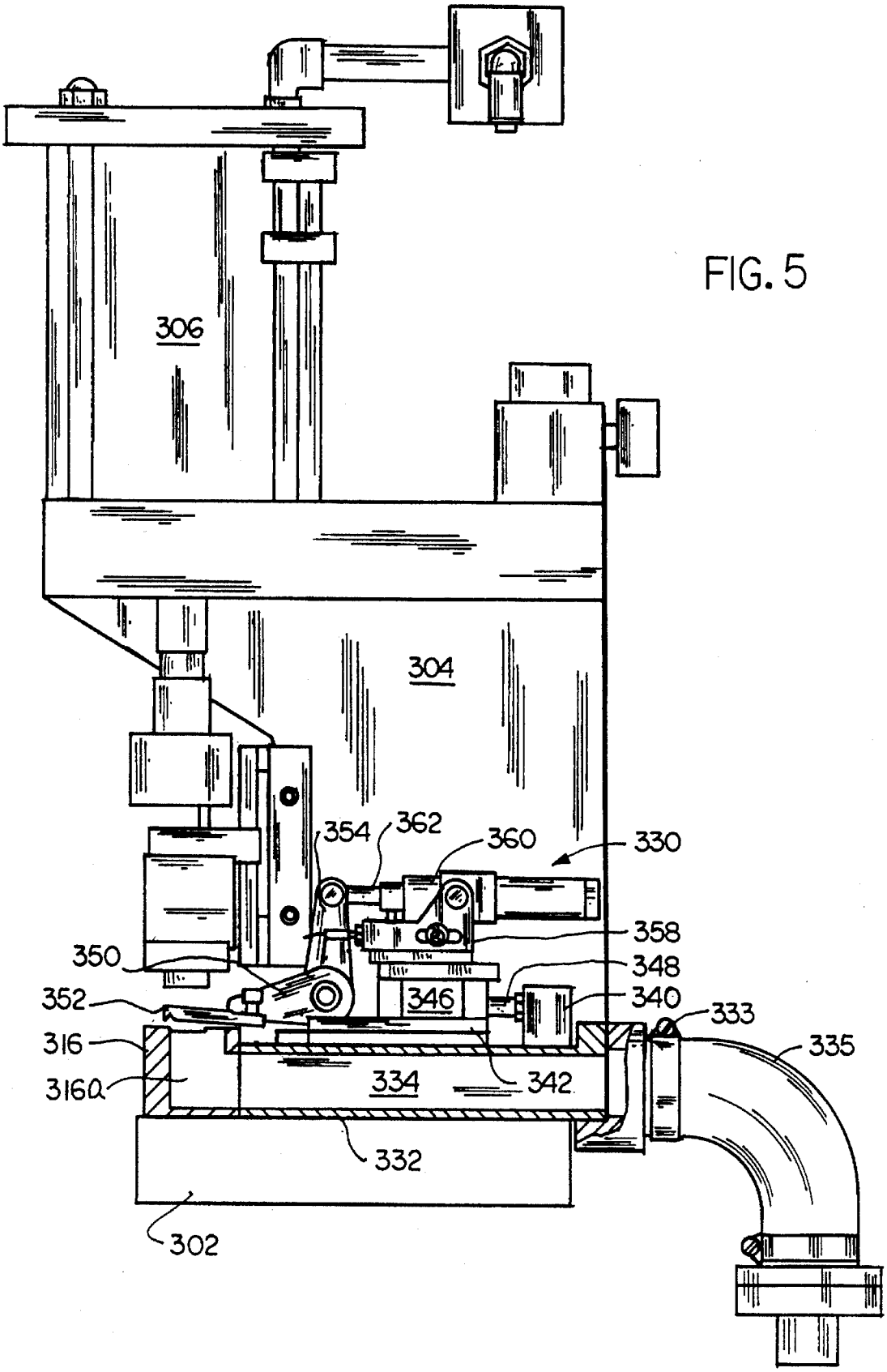
FIG. 5 is an end view of the die cutter station showing the scrapper assembly.

The die cutter assembly 300 is shown in FIGS. 4 and 5. The die cutter assembly includes a base support 302 and a frame 304 which extends upwardly from the base support 302. A cylinder 306 is mounted on top of the frame 304 and is actuated by a solenoid 308. The solenoid 308 is operatively connected to suitable controls (not shown) for actuating the cylinder 306 at the appropriate time. The piston 310 of the cylinder 306 is connected through a coupling 312 to the top plate 314 of a press. The base plate 316 of the press is fixedly mounted to the frame 304. A die 318 is secured to the top plate 314 by quick release clamps 320 which allows rapid changing of the cutting die. The die 318 carries a cutting rule 322 which is bent into an arcuate shape for making the fly cuts in the web material.

As the web material is conveyed, the edge of the web passes between the top plate 314 and base plate 316 of the press. The cylinder 304 is actuated in timed relationship with the web conveyance system 200 to lower the top plate 314. As the top plate 314 is lowered, the cutting rule 322 makes an arcuate cut in the edge of the web material.

The die cutter assembly 300 also includes a scrapper 330 for removing the scrap material severed from the web. The base plate 316 is formed with a passage 316a through which the scrap is removed. The passage 316a in the base plate 316 is connected to a corresponding passage 334 in a suction block 332. The suction block 332 is connected to a hose 335 via a coupling 333. The hose 335 is connected to a suitable vacuum source (not shown). A carriage block 342 is mounted on top of the suction block 332. The carriage block 342 slides back and forth on top of the suction block 332 in a direction perpendicular to the web conveyance means 200. The carriage block 342 is moved by a cylinder 346 which is mounted on the carriage 342. The piston rod 348 of the cylinder 346 is connected to a bracket 340 which is fixedly secured to the suction block 332.

A scrapper arm 350 is pivotally connected to the carriage 342. A scrapper blade 352 is mounted at the forward end of the scrapper arm 350 and extends over the base plate 316 in the die cutter press. The scrapper arm 350 is raised and lowered by a cylinder 360 which is connected to a lever or bell crank 354 of the scrapper arm 350. A pair of mounting brackets 358 are secured to the top of the carriage block 342 to form a trunion mount for the cylinder 360. When the rod 362 of the cylinder 360 is extended, the scrapper blade 352 is lowered against the base plate 316 to engage the scrap. Cylinder 346 is then actuated to pull the carriage block 342 rearwardly to drag the scrap material over the passage 316*a* and the base plate 316. When the scrap material is positioned over the passage 316*a* in the base plate 316, suction is applied to remove the scrap material. A sensor (not shown) detects the scrap material as it passes through the passage. If the scrap material is not detected, the scrapper 330 is automatically recycled until the scrap material is removed.

BINDING STATION

Figure 6:
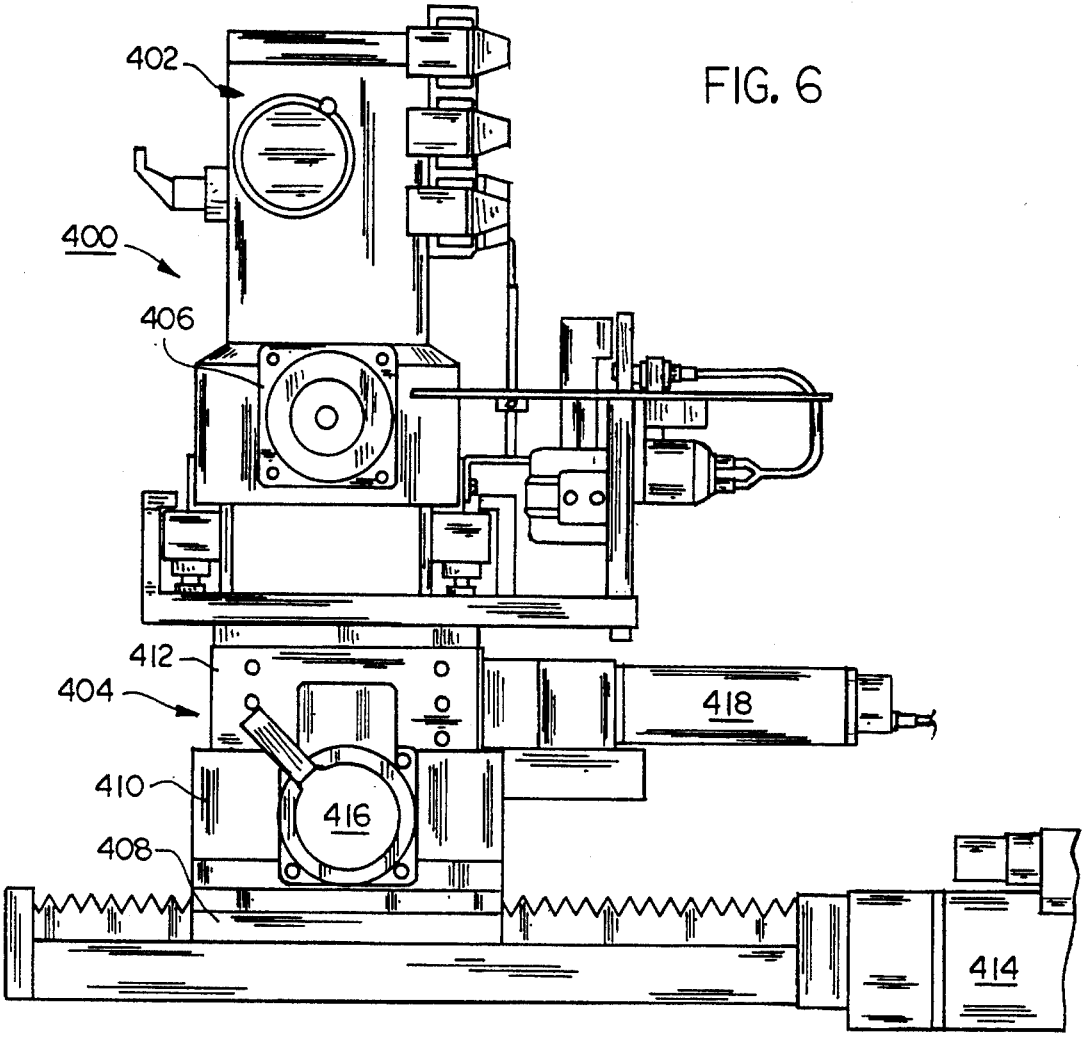
FIG. 6 is a side elevation of the binding station.
Figure 7:
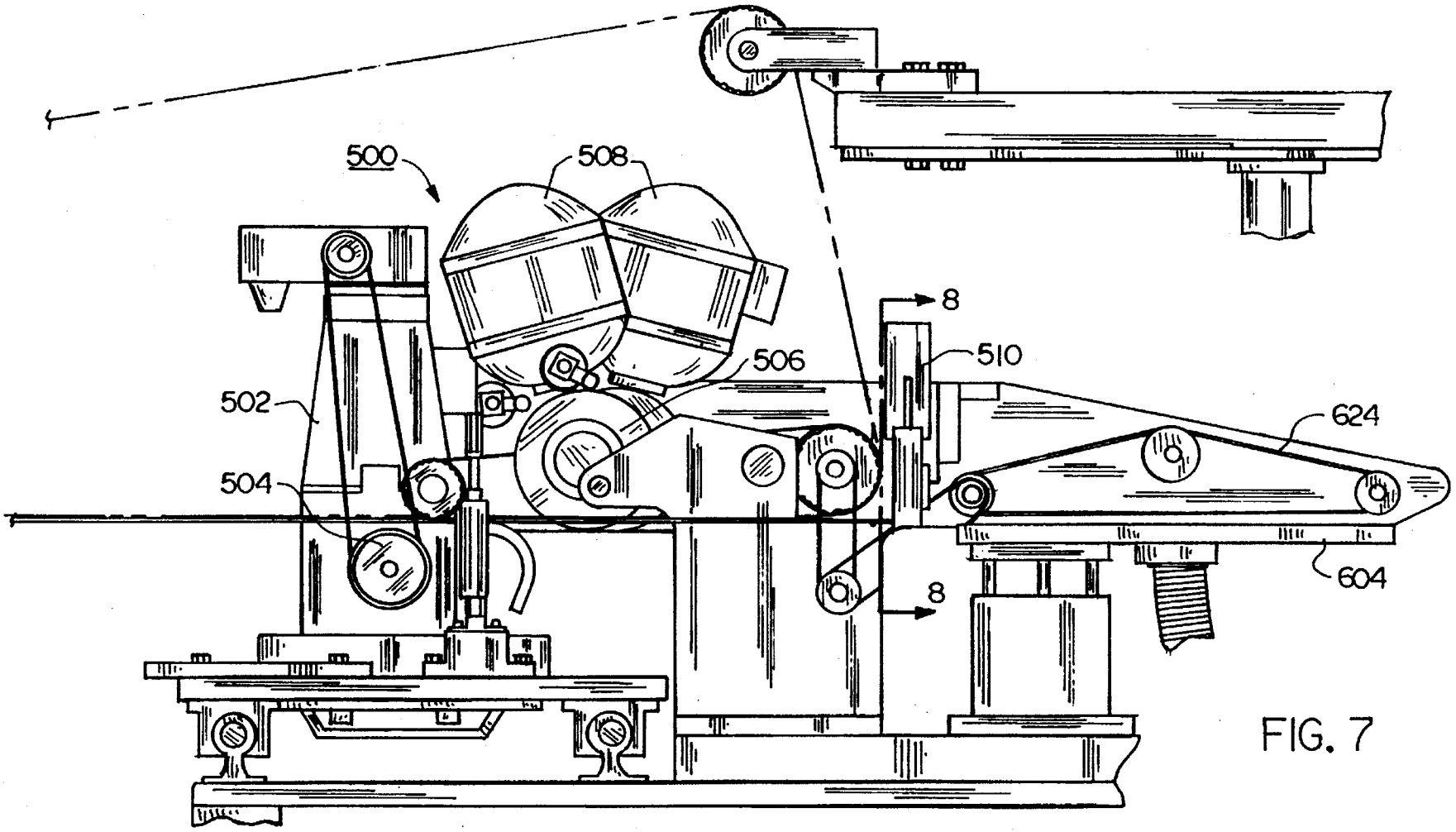
FIG. 7 is a side elevation of the finishing station.

The binding apparatus 400, shown in FIG. 6, includes a sewing machine 402 mounted on a positioning device 404. The sewing machine 402 is driven by a servomotor 406 which is actuated at the appropriate time by the main control system. The positioning device 404 comprises two linear slides 408, 410 and a rotary table 412. Linear slide 408 is mounted to the main frame of the front panel loader 10. The linear slide 408 is disposed perpendicular to the web conveyance means and is driven by a servo-motor 414. Linear slide 410 is mounted on top of the first linear slide 408 and is disposed parallel to the conveying system 200. A servo-motor 416 drives the linear slide 410. The rotary table 412 is mounted on top of the second linear slide 410. The rotary table 412 angularly positions the sewing machine 402. The rotary table 412 is driven by a servo-motor 418.

The servo-motors 414, 416 and 418 for the positioning device 404 are slaved to the servo-motor 406 and are programmed to move the sewing machine 402 in a predefined sequence when the sewing machine is actuated by the main control system. Binding material is fed into the sewing machine in a conventional fashion as the sewing machine is moved to stitch the binding on the arcuate cuts in the web material. The advancement of the web material is stopped during the binding operation. After the binding is complete, the web material is indexed by the conveyance means and binding material is applied to the next arcuate cut. Binding material is applied in sequence to each arcuate cut as the web material is indexed along the conveyor system.

FINISHING STATION

From the binding station 400, the conveyance means transports the web material to the finishing station 500. The finishing station 500 comprises a conventional sewing machine 502 which extends across the path of a web material. The sewing machine has two sewing needles which stitch the web material together along the outer edges thereof. The sewing machine 502 is driven by a servo-motor 504 which is controlled by the main control system. Servo-motor 504 is actuated simultaneously with the conveyance system 200 so that the sewing operation takes place while the web material is being advanced. A pair of cutting blades 506, which are driven by motors 508, are disposed immediately adjacent the sewing machine 502 for trimming the edges of the laminated web material. The joined web material is then conveyed through a guillotine cutter 510. The joined web material is held by the loader 600 as it is cut to length. The loader 600 is described in more detail below.

Figure 8:
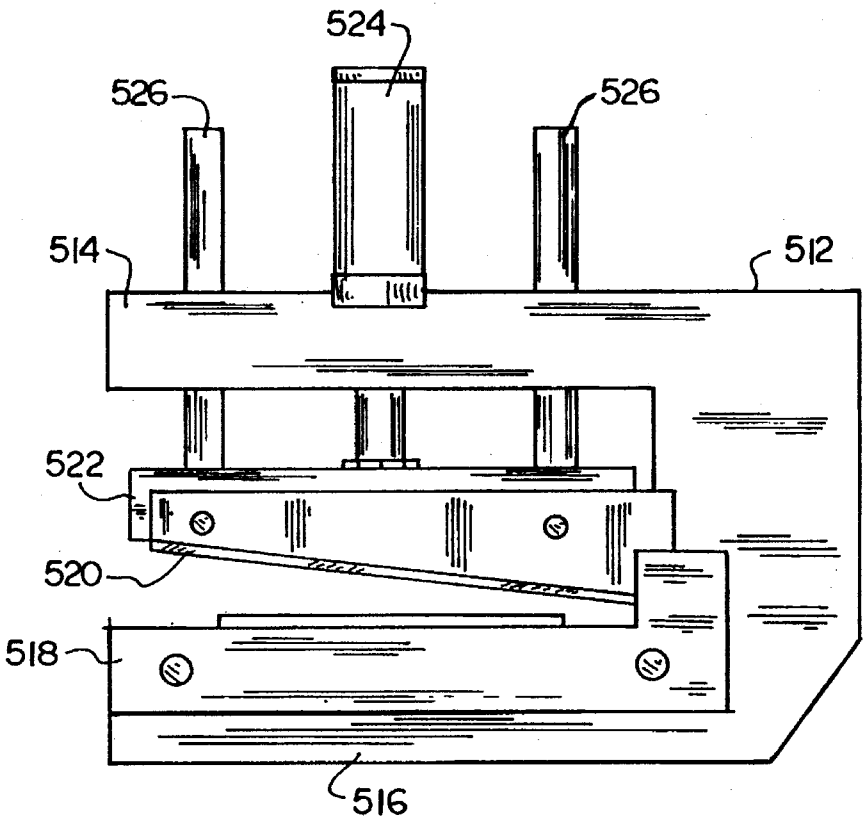
FIG. 8 is an end view of the guillotine cutter.

Referring now to FIG. 8, the guillotine cutter includes a c-frame 512 having an upper arm 514 and a lower arm 516. A stationary blade 518 is mounted to the lower arm 516. A moving blade 520 is mounted to a blade support 522 which is raised and lowered by a cylinder 524. Guide rods 526 pass through openings in the upper arm 514 to vertically guide the blade support 522. When cylinder 504 is actuated, the blade 520 is lowered to sever the web material into discrete front panel assemblies.

LOADING STATION

Figure 9:
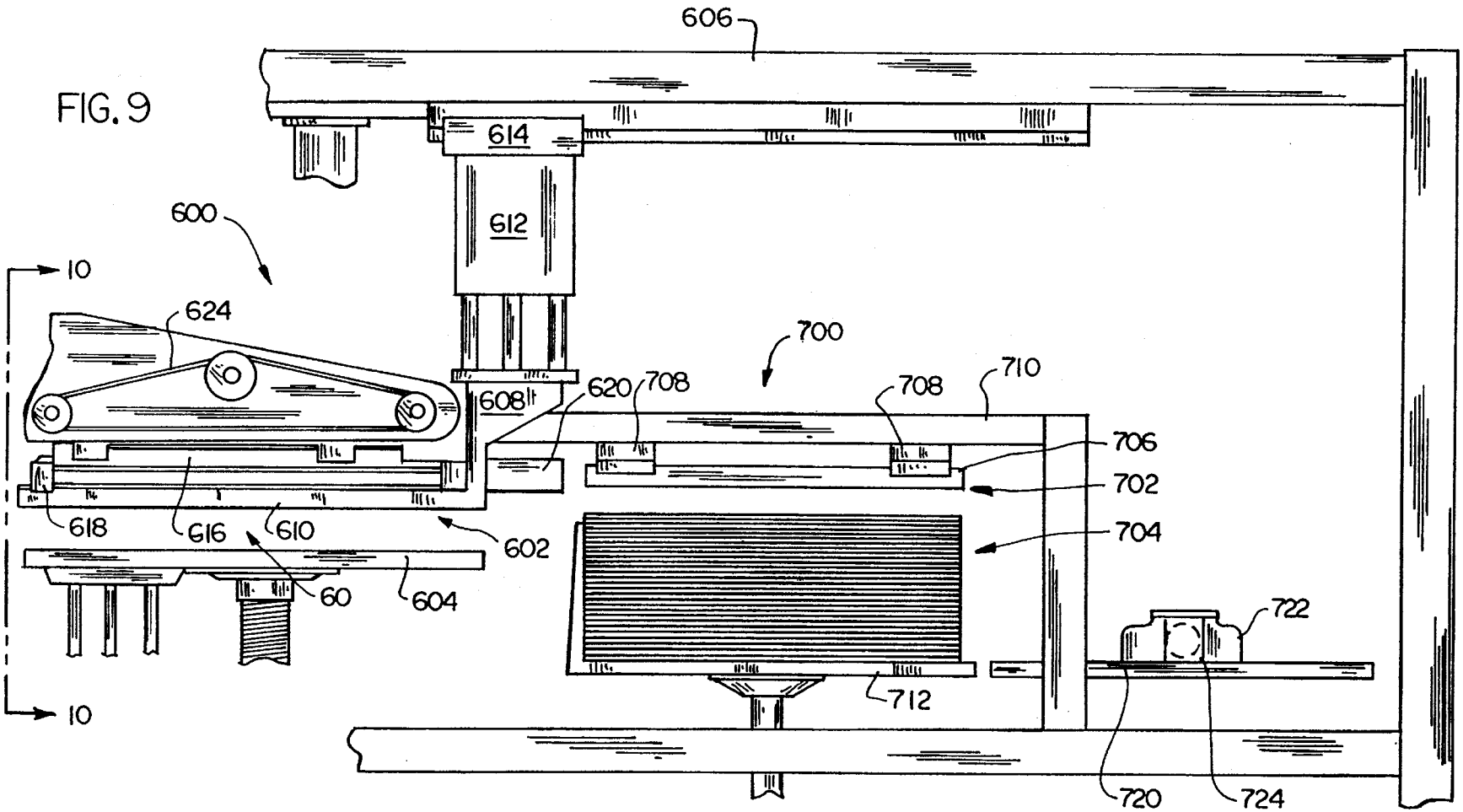
FIG. 9 is a side elevation of the loader and transfer mechanism.
Figure 11:
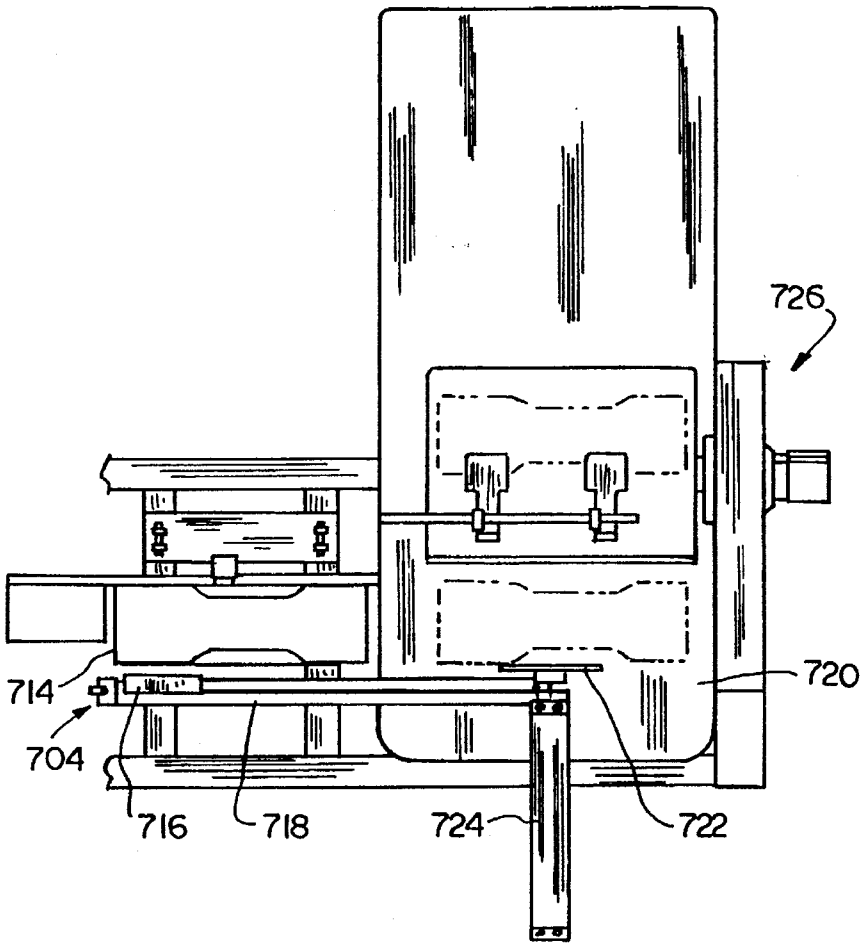
FIG. 11 is a top plan view of the transfer station.
Figure 10:
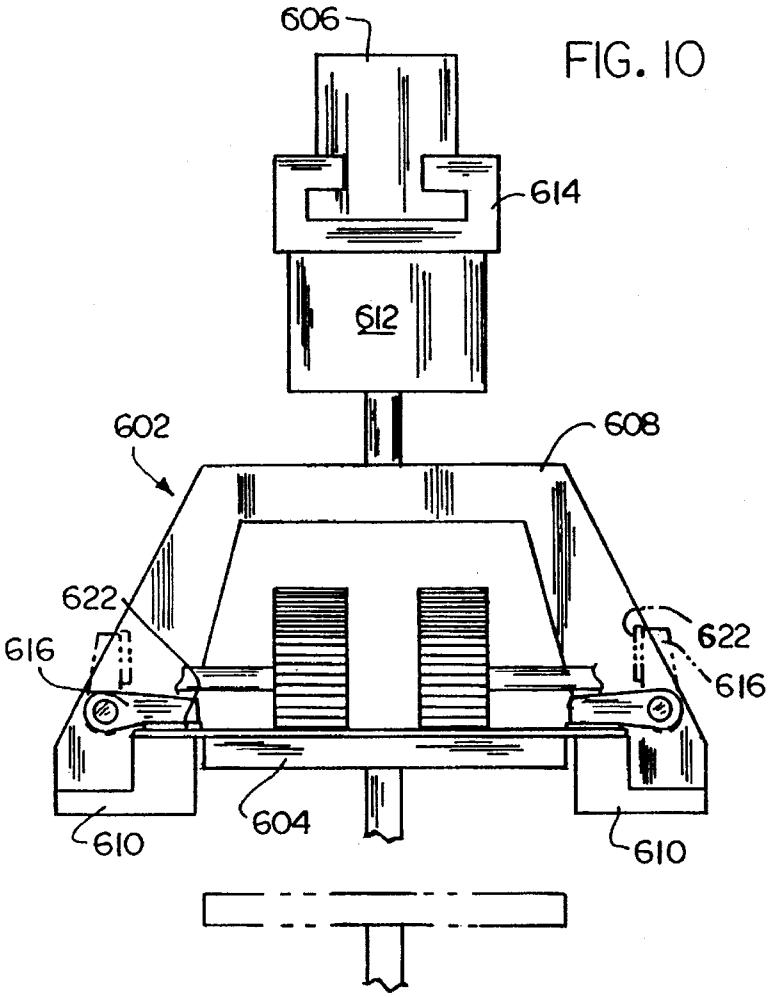
FIG. 10 is an end view of the loader.

Referring now to FIGS. 9–11, the loader 600 and transfer mechanism is shown. The loader 600 includes a gripper 602 and a movable platform 604. The gripper 602 is mounted for longitudinal movement on a track 606 which is supported by the frame of the front panel loader 10. The gripper 602 includes a yoke 608 (see FIG. 10) and a pair of fork-like gripper arms 610. The yoke 608 is connected to a cylinder 612 which is mounted by means of a linear slide 614 on the track 606. Thus, the gripper is capable of both longitudinal and vertical displacement.

Each gripper arm 610 carries a gripper jaw 616 which is shown in the figures in an open position. The gripper jaw 616 is pivotally journalled in a support 618 at one end. The opposite end is connected to a pneumatic rotary actuator 620 mounted on the yoke 608. The gripper jaw includes a resilient pad 622 for engaging the web material. The gripper jaws 616 pivot to a closed position to grip opposed edges of the web material after it is fed through the guillotine cutter by the conveyor 624.

When the web material is being conveyed into the gripper arms 610, the moveable platform 604 will be in a raised position as shown in FIG. 10 to support the web material. In this position, the top of the moveable platform 604 is flush with the clamping surfaces of the gripper arms 610. After the web material is indexed by the conveyor 624, the actuator 620 closes the gripper jaws 616 on the edges of the web material. The guillotine cutter severs the web material to form a front panel assembly. The moveable floor 604 is then lowered and cylinder 612 is actuated to lower the gripper 602 to disengage the web material from the conveyor 624. The gripper 602 then slides along the track 606 to the transfer station 700.

TRANSFER STATION

The transfer station 700 include a stripper 702 and a stacking bin 704. The stripper 702 strips the front panel assemblies from the gripper 602 and presses them down into the stacking bin 704. The stripper 702 includes a stripper plate 706 which is mounted on cylinders 708 which are secured to a support bar 710. The yoke 608 of the gripper 602 straddles the support bar 710.

The stacking bin includes a moveable floor 712 which is lowered incrementally as the panel assemblies are stacked thereon. A pusher 714 is mounted on a linear slide 716 which slides on a slide rail 718. The pusher 714 pushes the stacks of front panel assembly onto a table 720. A second pusher 722 which is mounted on a cylinder 724 pushes the stack of front panel assemblies into a commercial string tieing apparatus 726.

In operation, two bands of web material are conveyed by respective conveyors through the die cutting station 300 and binding station 400. The conveyor system 200 converges downstream of the binding station 400 to overlay the web material on top of one another. The web material is then conveyed through the finishing station 500 where the web material is sewn together along the outer edges thereof, trimmed, and cut to length to form discrete front panel assemblies. After exiting the finishing station 500, the loaders 600 transport the finished panel assemblies to a stacking bin 704 where the front panel assemblies are stacked. The transfer mechanism transfers the stack of front panel assemblies to the string tieing machine where the stacks are bundled.

Certain modifications and improvements will occur to those skilled in the art upon a reading of the foregoing description. By way of example, the transfer mechanism can be substituted by a holding fixture in which each finished front panel assembly is individually loaded. The front panel assembling can then be transported in the holding fixture to other stations where they are assembled with additional pieces to form a pair of men's briefs. It should be understood that all such modifications and improvements have been deleted herein for the sake of conciseness and readability but are properly within the scope of the following claims.

We claim:

1. An apparatus for manufacturing front panels for men's underwear from continuous bands of web material comprising:

(a) a pay-out mechanism for paying out said continuous bands of web material;

(b) a web conveyance system for conveying first and second continuous bands of web material along an assembly line;

(c) means disposed along said assembly line for fabricating discrete front panel assemblies from said continuous bands of web material;

(d) a loader for receiving the front panel assembly from the web conveyance system and transferring the front panel assemblies to a receiving apparatus, wherein the loader includes a gripper slidably mounted on a track for holding the front panel assemblies and transporting the front panel assemblies to the receiving apparatus and wherein the gripper comprises a pair of laterally-spaced arms disposed adjacent the outer edges of the front panel assembly, and a gripper jaw mounted on each gripper arm for gripping opposed edges of the front panel assembly; and (e) a stripper mechanism for stripping the front panel assembly from the gripper to transfer the front panel assembly to the receiving apparatus, wherein the stripper comprises a vertically moveable stripper plate for engaging the front panel assembly from above and pushing the front panel assembly downwardly into the receiving apparatus.

2. The apparatus of claim 1, wherein the pay-out mechanism includes first and second edge guides for aligning respective bands of web material with the web conveyance system.

3. The apparatus of claim 2, wherein the web supply is laterally off set from the edge guide to urge the band web material into contact with the edge guide.

4. The apparatus of claim 1, further including a stacking bin for receiving the front panel assemblies from the gripper.

5. The apparatus of claim 4, wherein the stacking bin includes a pusher for pushing stacks of front panel assemblies from the stacking bin.

6. The apparatus of claim 1, wherein said conveying system comprises first and second conveyors vertically aligned with one another.

7. The apparatus of claim 6, wherein upper and lower conveyors each include a pair of flexible drive members disposed in side-by-side relationship to one another, wherein said web material is fed between said flexible drive members and conveyed by said flexible drive members.

8. The apparatus of claim 7, wherein said upper and lower conveyors further include means for biasing the flexible drive members towards one another to provide positive pressure on the web material being conveyed.

9. The apparatus of claim 8, wherein said flexible drive members are endless belts.

10. An apparatus for manufacturing front panels for men's underwear from first and second continuous bands of web material conveyed by a web conveyance system from a supply source to a discharge station comprising:

(a) first and second die cutters disposed at a first station along said web conveyance system for making arcuate fly cuts in respective webs at a predetermined distance apart from one another;

(b) first and second binding apparatuses disposed at a second station along said web conveyance system downstream from said first station for binding the edges of said arcuate fly cuts;

(c) a sewing apparatus disposed at a third station along said web conveyance system downstream of said second station for joining the continuous webs along the outer edges thereof to form a laminate;

(d) a trimming apparatus disposed at a fourth station along said web conveyance system downstream of said third station for trimming the opposed edges of the laminated web material; and (e) cutting means for cutting said laminated web material into predetermined lengths to form discrete front panel assemblies from said laminated web material.

11. The apparatus of claim 10, further including scrap removing means disposed adjacent said first and second die cutters for removing scrap material therefrom.

12. The apparatus of claim 11, wherein the scrap removing means includes a suctioning device for suctioning scrap material from said die cutters.

13. The apparatus of claim 12, wherein the scrap removing means further includes a mechanical scrapper for engaging the scrap material removed from the continuous web and drawing the scrap material towards the suctioning device.

14. The apparatus of claim 10, wherein the first and second binding apparatuses comprise a sewing machine driven by a servo-motor in timed relationship with the web conveyance systems for stitching a binding material to the edge of the arcuate fly cuts.

15. The apparatus of claim 14, further including a turntable supporting said sewing machine for rotating the sewing apparatus during the stitching operation to track along the arcuate fly cut.

16. The apparatus of claim 15, wherein the binding apparatus further includes a second servo-motor for rotating the turntable in timed relationship with the web conveyance system.

17. The apparatus of claim 16, wherein the binding apparatus includes positioning means for positioning the sewing machine with respect to the continuous web.

18. The sewing apparatus of claim 17, wherein the positioning means comprises a third servo-motor slaved to said first servo-motor for moving the sewing apparatus perpendicular to the motion of the continuous web, and a fourth servo-motor slaved to said first servo-motor for moving the sewing apparatus in a direction parallel to the movement of the continuous web.

19. An apparatus for manufacturing front panels for men's underwear from continuous bands of web material comprising:

(a) a pay-out mechanism for paying out said continuous bands of web material;

(b) a web conveyance system for conveying first and second continuous bands of web material along an assembly line;

(c) means disposed along said assembly line for fabricating discrete front panel assemblies from said continuous bands of web material, said means including: (i) first and second die cutters disposed at a first station along said web conveyance system for making arcuate fly cuts in respective webs at a predetermined distance apart from one another; (ii) first and second binding apparatuses disposed at a second station along said web conveyance system downstream from said first station for binding the edges of said arcuate fly cuts; (iii) a sewing apparatus disposed at a third station along said web conveyance system downstream of said second station for joining the continuous webs along the outer edges thereof to form a laminate; (iv) a trimming apparatus disposed at a fourth station along said web conveyance system downstream of said third station for trimming the opposed edges of the laminated web material; and (v) cutting means for cutting said laminated web material into predetermined lengths to form discrete front panel assemblies from said laminated web material; and (d) a loader for receiving the front panel assembly from the web conveyance system and transferring the front panel assemblies to a receiving apparatus.

20. The apparatus of claim 19, wherein the pay-out mechanism includes first and second edge guides for aligning respective bands of web material with the web conveyance system.

21. The apparatus of claim 20, wherein the web supply is laterally off set from the edge guide to urge the band web material into contact with the edge guide.

22. The apparatus of claim 19, wherein the loader includes a gripper slidably mounted on a track for holding the front panel assemblies and transporting the front panel assemblies to the receiving apparatus.

23. The apparatus of claim 22, wherein the gripper comprises a pair of laterally-spaced arms disposed adjacent the outer edges of the front panel assembly, and a gripper jaw mounted on each gripper arm for gripping opposed edges of the front panel assembly.

24. The apparatus of claim 23, further including a stripper mechanism for stripping the front panel assembly from the gripper to transfer the front panel assembly to the receiving apparatus.

25. The apparatus of claim 24, wherein the stripper comprises a vertically moveable stripper plate for engaging the front panel assembly from above and pushing the front panel assembly downwardly into the receiving apparatus.

26. The apparatus of claim 25, further including a stacking bin for receiving the front panel assemblies from the gripper.

27. The apparatus of claim 26, wherein the stacking bin includes a pusher for pushing stacks of front panel assemblies from the stacking bin.

28. The apparatus of claim 19, wherein said conveying system comprises first and second conveyors vertically aligned with one another.

29. The apparatus of claim 28, wherein upper and lower conveyors each include a pair of flexible drive members disposed in side-by-side relationship to one another, wherein said web material is fed between said flexible drive members and conveyed by said flexible drive members.

30. The apparatus of claim 29, wherein said upper and lower conveyors further include means for biasing the flexible drive members towards one another to provide positive pressure on the web material being conveyed.

31. The apparatus of claim 30, wherein said flexible drive members are endless belts.

32. The apparatus of claim 14, further including scrap removing means disposed adjacent said first and second die cutters for removing scrap material therefrom.

33. The apparatus of claim 32, wherein the scrap removing means includes a suctioning device for suctioning scrap material from said die cutters.

34. The apparatus of claim 33, wherein the scrap removing means further includes a mechanical scrapper for engaging the scrap material removed from the continuous web and drawing the scrap material towards the suctioning device.

35. The apparatus of claim 19, wherein the first and second binding apparatuses comprise a sewing machine driven by a servo-motor in timed relationship with the web conveyance systems for stitching a binding material to the edge of the arcuate fly cuts.

36. The apparatus of claim 35, further including a turntable supporting said sewing machine for rotating the sewing apparatus during the stitching operation to track along the arcuate fly cut.

37. The apparatus of claim 36, wherein the binding apparatus further includes a second servo-motor for rotating the turntable in timed relationship with the web conveyance system.

38. The apparatus of claim 37, wherein the binding apparatus includes positioning means for positioning the sewing machine with respect to the continuous web.

39. The sewing apparatus of claim 38, wherein the positioning means comprises a third servo-motor slaved to said first servo-motor for moving the sewing apparatus perpendicular to the motion of the continuous web, and a fourth servo-motor slaved to said first servo-motor for moving the sewing apparatus in a direction parallel to the movement of the continuous web.

40. A method for manufacturing front panel assemblies from first and second continuous bands of a web material conveyed by a web conveyance system from a supply source to a discharge station comprising the steps of:

(a) making arcuate fly cuts in a selected edge of each band of web material at a first station along the path of travel of the band material, said arcuate fly cuts being made at predetermined intervals;

(b) sewing a binding material to the edge of the arcuate fly cuts at a second station along the path of travel of the band material;

(c) disposing the first and second bands of web material in overlapping relationship;

(d) sewing the bands of web material together along their outer edges at a third station to form a two-ply laminate;

(e) trimming selvage from the opposed edges of the laminated band material at a fourth station along the path of travel of the band material; and (f) cutting the laminated band material into predetermined lengths at a fifth station along the path of travel of the band material to form discrete front panel assemblies.

41. A method for manufacturing front panel assemblies from continuous bands of a web material comprising the steps of:

(a) paying out first and second continuous bands of web material;

(b) conveying said first and second continuous bands of web material from respective supplies along an assembly line to a discharge station;

(c) making arcuate fly cuts in a selected edge of each band of web material at a first station along the path of travel of the band material, said arcuate fly cuts being made at predetermined intervals;

(d) sewing a binding material to the edge of the arcuate fly cuts at a second station along the path of travel of the band material;

(e) disposing the first and second bands of web material in overlapping relationship;

(f) sewing the bands of web material together along their outer edges at a third station to form a two-ply laminate;

(g) trimming selvage from the opposed edges of the laminated band material at a fourth station along the path of travel of the band material;

(h) cutting the laminated band material into predetermined lengths at a fifth station along the path of travel of the band material to form discrete front panel assemblies; and (i) receiving the front panel assembly and transferring said discrete front panel assemblies to a receiving apparatus.

* * * * *